US007658635B2

(12) United States Patent
Gilchrist

(10) Patent No.: US 7,658,635 B2
(45) Date of Patent: Feb. 9, 2010

(54) PLUG ADAPTER

(75) Inventor: Peter M. Gilchrist, Angeles (PH)

(73) Assignee: Sandal PLC (GB)

( * ) Notice: Subject to any disclaimer, the term of this patent is extended or adjusted under 35 U.S.C. 154(b) by 141 days.

(21) Appl. No.: 10/548,783

(22) PCT Filed: Mar. 10, 2004

(86) PCT No.: PCT/GB2004/001001

§ 371 (c)(1),
(2), (4) Date: Oct. 10, 2006

(87) PCT Pub. No.: WO2004/082082

PCT Pub. Date: Sep. 23, 2004

(65) Prior Publication Data

US 2007/0015389 A1 Jan. 18, 2007

(30) Foreign Application Priority Data

Mar. 11, 2003 (GB) ..... 0305550.6

(51) Int. Cl.
*H01R 13/627* (2006.01)

(52) U.S. Cl. ..... 439/357

(58) Field of Classification Search ..... 439/347, 439/357, 651, 650, 170, 372, 218, 221
See application file for complete search history.

(56) References Cited

U.S. PATENT DOCUMENTS

| | | | | | |
|---|---|---|---|---|---|
| 2,499,825 | A | * | 3/1950 | Havlicek | 439/282 |
| 2,732,531 | A | * | 1/1956 | Janowiec | 439/346 |
| 2,799,009 | A | * | 7/1957 | Benander | 439/346 |
| 4,917,625 | A | * | 4/1990 | Haile | 439/358 |
| 5,052,943 | A | * | 10/1991 | Davis | 439/357 |
| 5,075,615 | A | * | 12/1991 | Dantis | 320/111 |
| 5,454,729 | A | * | 10/1995 | Wen-Te | 439/357 |
| 6,033,249 | A | | 3/2000 | Holzer | 439/356 |

FOREIGN PATENT DOCUMENTS

| | | |
|---|---|---|
| DE | 33 27 087 C1 | 8/1984 |
| DE | 40 41 576 A1 | 12/1990 |
| EP | 0 342 942 A1 | 5/1989 |
| FR | 2 883 637 | 3/2005 |
| GB | 2 261 774 A | 2/1992 |
| GB | 2 355 865 A | 10/1999 |
| WO | WO 98/43319 | 10/1998 |

* cited by examiner

*Primary Examiner*—Phuong K Dinh
(74) *Attorney, Agent, or Firm*—Renner Kenner Greive Bobak Taylor & Weber

(57) ABSTRACT

An electrical adapter with a first pin configuration comprises a body for receiving and supporting a plug with a second pin configuration such that the pins of the plug are in electrical contact to the pins on the body, wherein the body is provided with a moveable member engageable by the plug and disposed to allow the plug to be inserted into the adapter but to restrict the retraction of the plug from the adapter.

7 Claims, 4 Drawing Sheets

PLUG ADAPTER

The present invention relates to adapter plugs. More particularly, the present invention relates to a locking mechanism being arranged in a three pin plug adapter so as to permanently incorporate a two pin plug.

Adapter plugs are well known in the art. An adapter plug is utilised to convert a two-pin plug into a three-pin plug. For safety reasons, it is more advantageous for a two pin plug to be retained by a three-pin adapter so as to prevent removal of the two pin plug while the adapter is plugged into a socket. Available plug adapters utilise a variety of mechanisms which will allow the two-pin plug to be inserted into or removed from the three-pin adapter only when the adapter is removed from the socket. However, they lack reliability as they are not held in permanently such that manipulation of the two-pin plug may result in the plug being removed from the adapter which is undesirable for the user or they are costly to fit to a two-pin plug. Further, the prior art arrangements result in the user having to carry out a variety of operations which can be time consuming and labour intensive.

For example, patent publication, GB 2 261 774 A discloses a connector in which a two pin plug before the casing is assembled. Similar arrangements are disclosed in WO 91/19335 A1 and EP 0 342 942 A2.

Furthermore, an electrical connecting device is disclosed in GB 2 355 865 A. The device receives an electrical plug and retains the plug using a tightening means which is preferably a screw. A similar tightening requirement is also necessary according to the disclosure of US 2002/0182905.

In the light of the above, an object of the present invention is to overcome the drawbacks of known devices and provide an alternative and improved design of electrical adapter plug which is easy to use and requires relatively little work by the user to secure a plug which requires conversion in the adapter plug.

Accordingly, from a first aspect the present invention provides an electrical adapter with a first pin configuration comprising a body having an opening for receiving a plug with a second pin configuration such that the pins of the plug are in electrical contact with pins on the body, wherein the body is provided with a moveable member engageable by the plug and disposed to allow the plug to be inserted in a first direction into the adapter through the opening but to restrict the retraction of the plug from the adapter in a second direction opposite to the first.

The pin configuration may be determined by the number of pins, the shape of the pins or the relative disposition of the pins. In a preferred embodiment, the first pin configuration comprises three pins arranged to be recognised by a United Kingdom mains socket and the second pin configuration comprises two pins arranged in a continental Europe, US or Australian configuration.

The moveable component may have natural resilience arranged to provide a force against the plug or it may be biased into engagement with the plug.

Alternatively, the moveable component may be a ratchet arranged to interact with a pawl so as to provide an opposing force against a surface of the plug when a pulling force is applied to the plug.

In order that the present invention be more readily understood embodiments thereof will now be described by way of example only with reference to the accompanying drawings in which.

Figure 1:
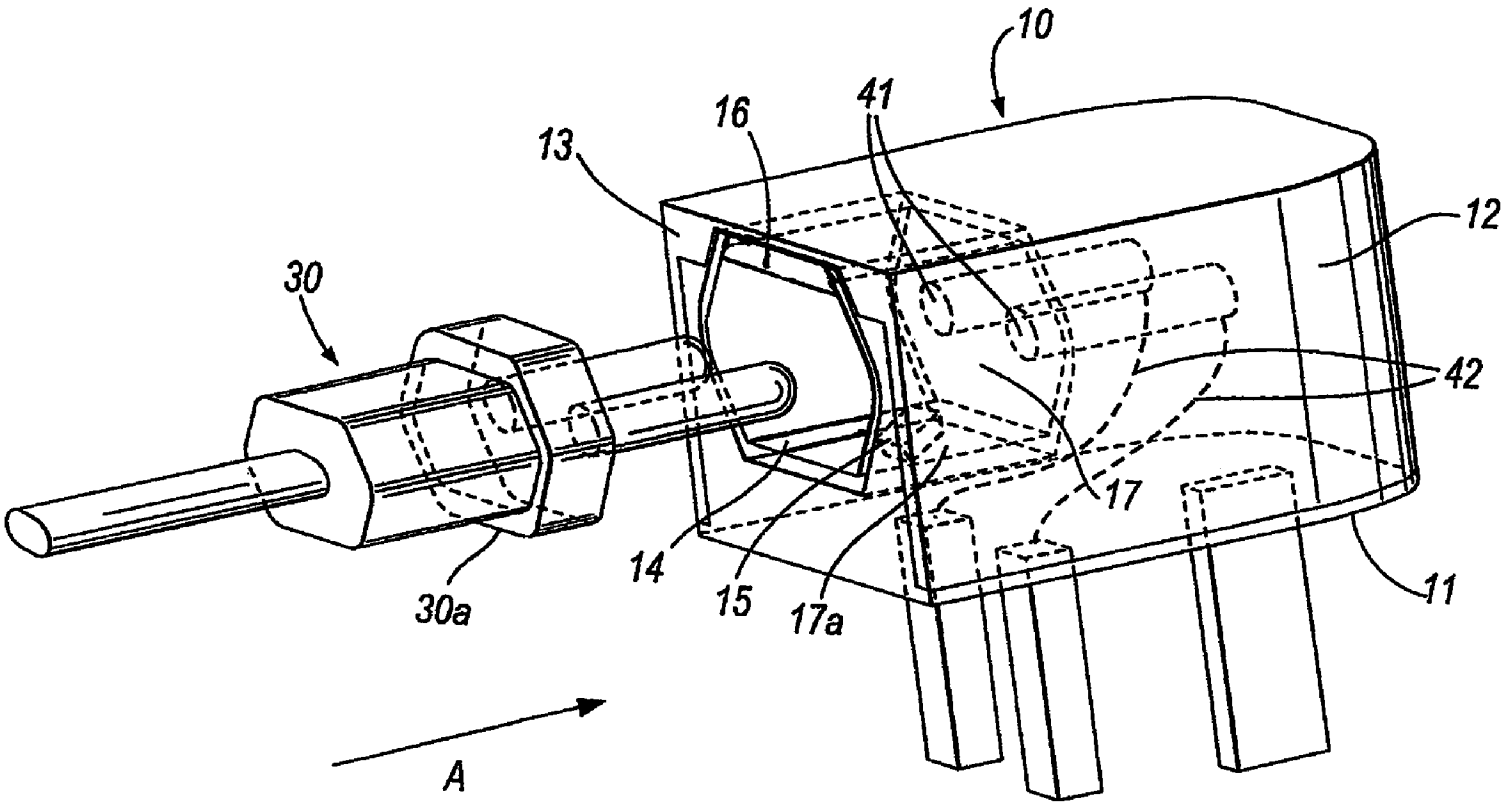
FIG. 1 is an isometric view of one embodiment of the present invention.

The preferred embodiment of the present invention provides a three pin plug adapter 10 which can receive a two pin plug 30 simply by pushing the plug into the adapter but which resists retraction of the plug. A first embodiment of the present invention will now be described with reference to FIG. 1.

The three pin plug adapter 10 comprises a housing formed by a base member 11 which carries the usual three pins, an insert 17, fuse and connections 42 as well as a cover 12. The cover 12 is arranged to be permanently connected to the base member 11 so as to form an enclosure for a two-pin plug, eg one conforming to European, US or Australian standards. A rear wall 13 of the housing is located on a side adjacent to the base member 11 and is formed with an opening 14 for the insertion of a two pin plug 30 in the direction of the arrow A. The two pins of the plug 30 are received in holes 41 which permit the plug 30 to be connected to the connections 42 of the adapter base member 11. The opening 14 is of a sufficient size so that the two pin plug 30 can be easily inserted into the body of the adapter 10.

The direction A of insertion according to the present embodiment is substantially perpendicular to the longitudinal axis of the pins of the adapter 11. that is, the direction A is such that the plug is inserted in a direction parallel to the planar surface of the base member 11. This particular direction of insertion is utilised when the opening 14 is located on a side adjacent to the base member 11. However, it will be appreciated that the insert 17 may be arranged differently within the housing of the adapter 10 to accommodate for the plug 30 to be inserted differently into the adapter 11. For example, the insert 17 may be arranged within the housing to accept a plug when the direction of insertion is substantially parallel to the longitudinal axis of the adapter pins. That is, when the direction of insertion is substantially perpendicular to the planar surface of the base member 11. This direction of insertion is required when opening is located on an opposite side of the housing to that of the base member 11.

The insert 17 of the base member is provided with a component 15 which may be moved or deformed in order to permit the insertion of the two-pin plug 30 in the direction of the arrow A but will resist the retraction of the plug 30 from the adapter 10 in the opposite direction. The component 15 may be inherently resilient and made from nylon or similar material, and may further be supported by a spring made from rubber or metal. Furthermore, the component 15 pivots about a point on one internal surface of the adapter 10. Alternatively, the restriction of motion in one direction may be achieved by simply using a saw tooth structured component 15. The component 15 is arranged such that a forced movement of the component from its default position will cause the component to attempt to return to its default position by exerting a high force. The component 15 forms a locking mechanism such that the insertion of the two pin plug 30 will be permitted but the retraction of the plug 30 will be restricted so the two pin plug is permanently retained in the three pin adapter.

When the two pin plug is inserted through the opening 14 it presses the component 15 down towards an inner (upper) surface 17*a* of the insert 17. As shown in FIG. 1, the inner (upper) surface 17*a* is the surface of the insert 17 closest to the surface of the base member 11. The natural spring effect of component 15 causes it to attempt to regain its default position by exerting a force on the corresponding surface 30*a* of the two pin plug. The greater the pulling force on the two pin plug, the greater the force exerted on the two pin plug by the component 15 to such an extent that any movement is prevented. If needed, removal of the two pin plug can be further resisted by the fixed component 16 which exerts an opposing force to the pulling force of the two pin plug. The component 16 is located on the other side of the opening to component 15 and is displaced from component 15 in the direction of insertion. This reduces the force required for insertion of the two-pin plug while adding to the resistance to removal of the two-pin plug. Thus, the two pin plug 30 is securely retained inside the adapter 10.

Figure 2:
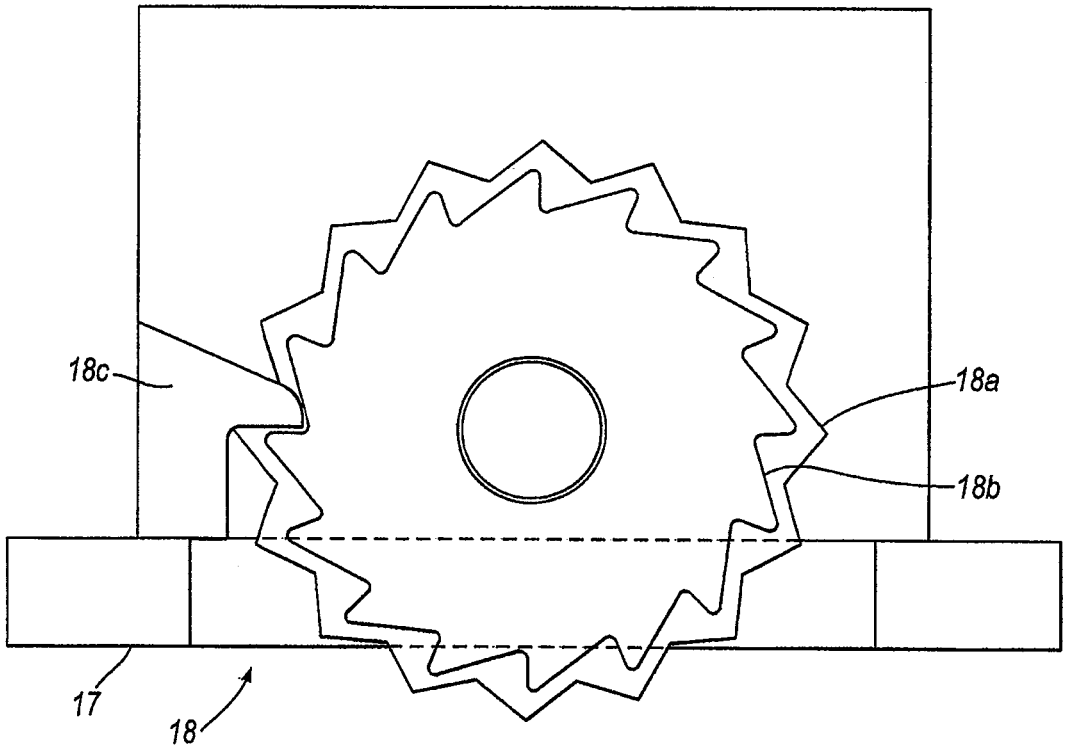
FIG. 2 shows a diagrammatic side view of a second form of locking mechanism for use in FIG. 1.

In another embodiment of the present invention shown in FIG. 2, the component 15 is replaced with another configuration 18 which achieves the same purpose of preventing the removal of the two pin plug 30. The configuration 18 comprises a small toothed wheel 18*a* with a ratchet 18*b* arranged on one side of the wheel 18*a*, and a pawl 18*c* to interact with the ratchet 18*b*. The pawl is positioned in an insert 17 of the adapter 10 such that the rotation of the wheel 18*a* will permit entry of the two pin plug 30 but will prevent the backward rotation and hence the removal of the two pin plug from the adaptor 10. The configuration 18 is arranged on the inner surface 17*a* of the converter 10, such that a small section of the wheel 18*a* and ratchet 18*b* is in contact with the two pin plug 30 when removal of the plug 30 is attempted. Additionally, the locking mechanism may comprise the fixed component 16 as described hereinbefore to prevent removal of the two pin plug.

Figure 3:
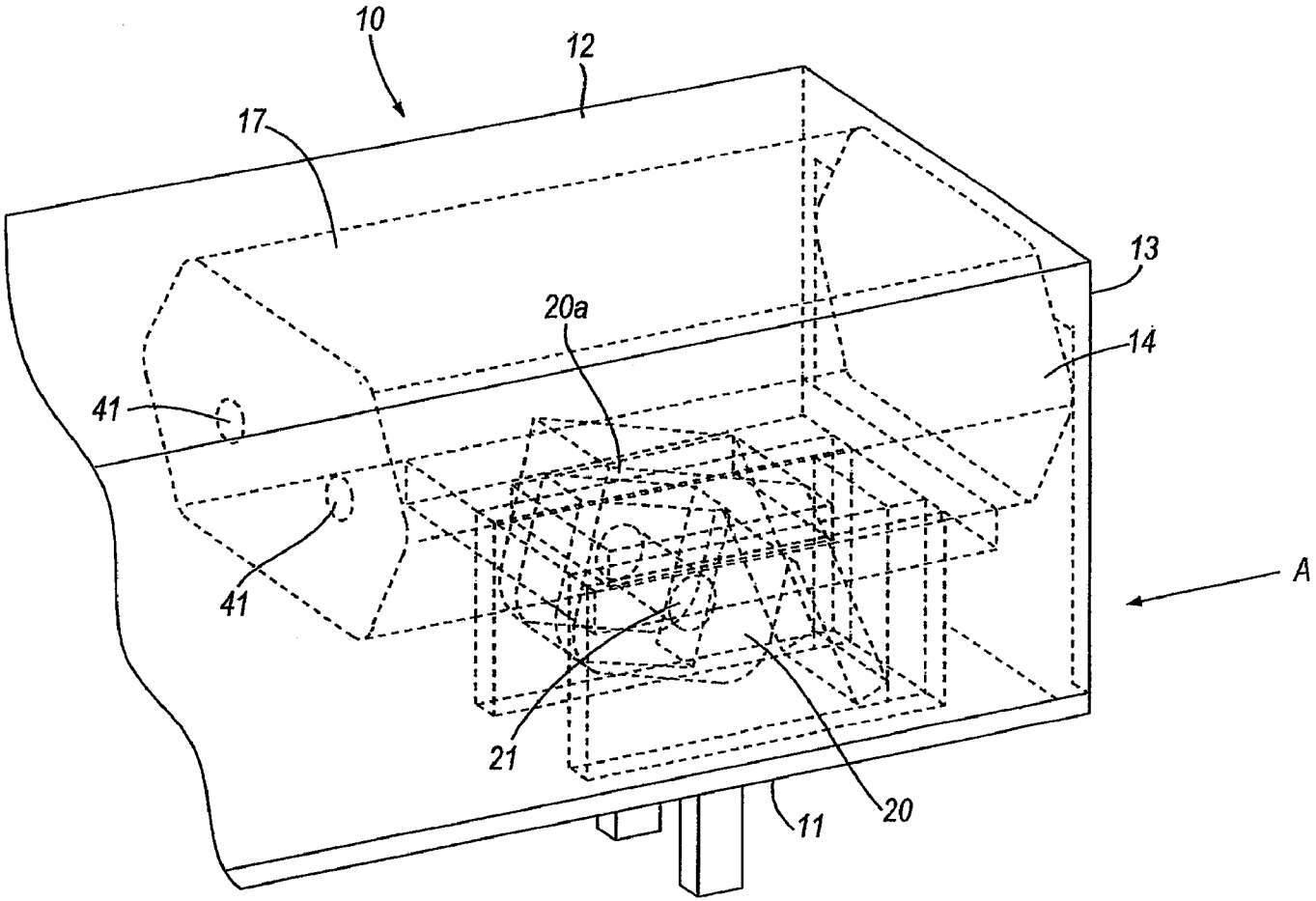
FIG. 3 is an isometric view of a second embodiment of the present invention.
Figure 3A:
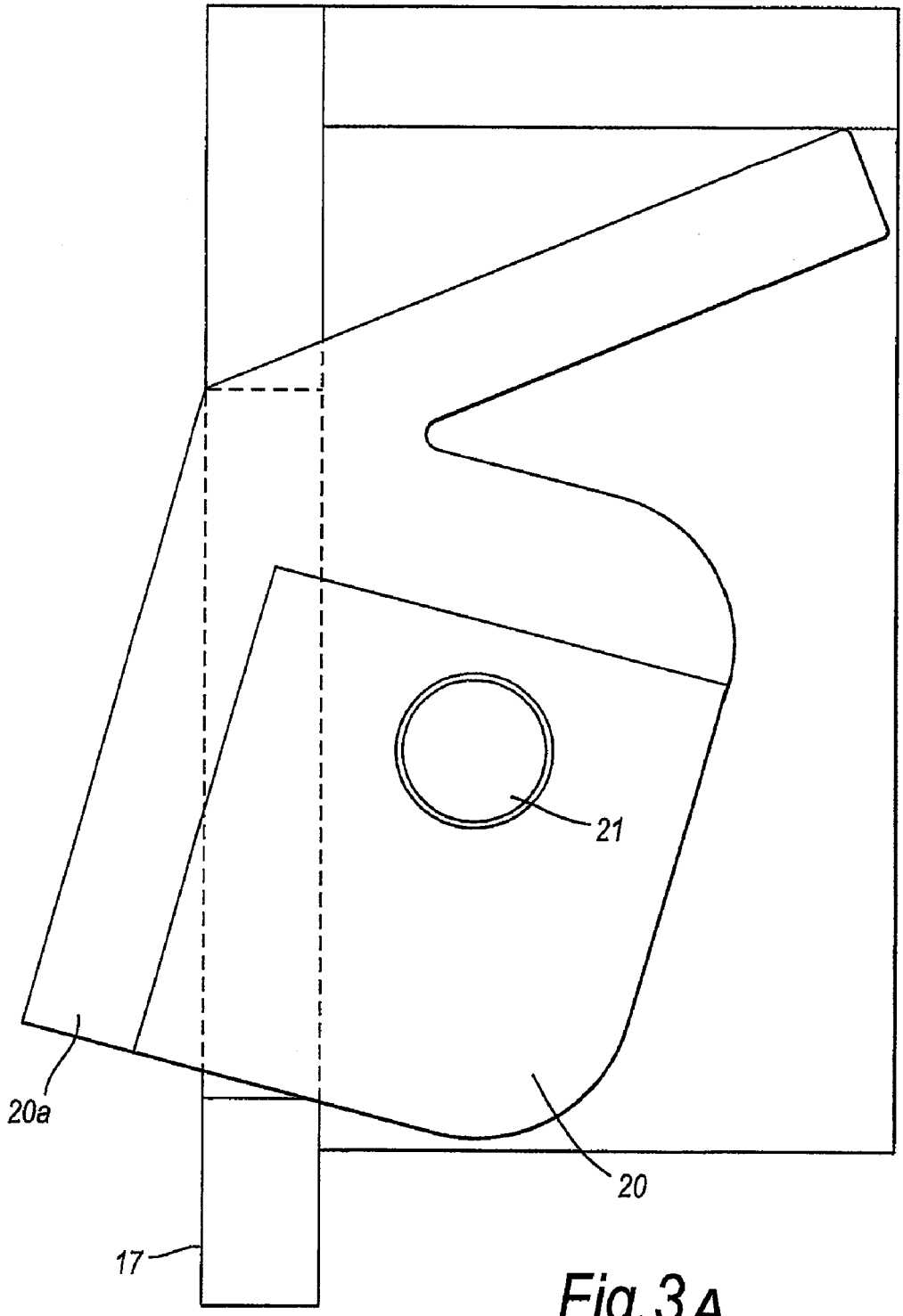
FIG. 3A shows a diagrammatic side view of the locking mechanism depicted in FIG. 3.

FIG. 3 is a third embodiment of the locking mechanism which provides a further replacement for the locking mechanism as described in any of the two previous embodiments of the present invention.

The component 20 is a spring loaded component which is provided into the insert 17 of the adapter 10. A small portion 20*a* of the component protrudes from the insert such that the protruding portion is moved in towards the insert 17 as the two pin plug 30 is inserted into the adapter 10. As the component 20 is pivotally arranged about a pivot 21 and has spring like properties, movement of the component 20 causes it to provide a force to the two pin plug 30 thus preventing the plugs removal.

It will be appreciated that the aforementioned locking mechanism according to the three embodiments described is not limited to use in an adapter and may be utilised in a similar manner to provide the same locking effect.

The cover 12 is preferably permanently attached to the base 11 by being bonded to it. Alternatively, a release mechanism (not shown) may be incorporated into the adapter 10 with access only when the adapter 10 is not plugged in a socket and is accessible through an opening in the base member 11 of the adapter 10. Preferably, the release mechanism will require the use of a tool to effect the release of the two pin plug 30 from the converter 10. However, it will be appreciated that no tools are required to insert and secure the two pin plug.

Moreover, the structure of the adapter 10 is such that it comprises a unitary body which cannot be taken apart to access the two pin plug. The only way to access the internal elements of the adapter 10 would be to force the adapter 10 open which would destroy the adapter and make it unusable. Another effect of the permanent retention of the plug in this manner is an improvement to the safety of the adapter. To achieve the unitary body structure, the manufacture of the adapter may be carried out by moulding two pieces of the adapter together. For example, the base member 11 would be provided with the insert 17 and the other internal elements of the plug to form one piece and the cover 12 which forms the second piece would be moulded to form the unitary structure. It will be apparent to those skilled in the art that any combination may be utilised to form the unitary structure.

It will be appreciated that the present invention is not restricted to a two pin plug for a three pin adapter and may utilise other pin configurations which may lead to the adapter to be of a different size or structure to a conventional three pin UK plug. Hence, the adapter may be configured to accept any plug from any country which requires conversion leading to the adapter having an unconventional structure and able to convert to any other national format.

Further, it will be appreciated that the moveable member may contact the body of the plug to which the plug which is inserted into the adapter rather than the pins of the plug. Moreover, the shape of the body of the plug may to aid in the retention of the plug. For example, the body may be curved or smooth. A curved shape may affect the force required by the moveable member of the locking mechanism to retain the plug. Indeed, plugs with certain shaped bodies will be contacted by the moveable member in such a manner that the shape contributes to the retention of the plug. In accordance with the above, the adapter is capable of being utilised with plug bodies of various shapes.

The invention claimed is:

1. An electrical adapter for inserting into an electrical plug socket, the adapter comprising a base with a first pin configuration and a cover, and having an opening for receiving a plug having an insulative casing that supports plural pins with a second pin configuration such that the pins of the plug are in electrical contact with pins on the base, wherein the base is provided with a moveable component disposed in the path of insertion of the plug and engageable by the plug casing on insertion such that the plug casing causes the component to move in order to allow the plug casing to be inserted into the adapter in a first direction through the opening but to permanently prevent the retraction of the plug casing from the adapter in a second direction opposite to the first.

2. The electrical adapter according to claim 1 wherein the first pin configuration comprises three pins and the second pin configuration of the plug comprises two pins.

3. The electrical adapter according to claim 1 wherein the moveable component is positioned on one side of the opening and the base is further provided with a fixed component located on the other side of the opening to the moveable component and is displaced from the moveable component in the direction of insertion of the plug.

4. The electrical adapter according to claim 1, wherein the moveable component is inherently resilient.

5. The electrical adapter according to claim 1, wherein the moveable component is a toothed wheel with a ratchet arranged on one side of the wheel, such that the ratchet interacts with a pawl to allow rotation of the wheel in one direction but to prohibit rotation of the wheel in the opposite direction.

6. The electrical adapter according to claim 1, wherein the base of the adapter is permanently attached to the cover so as to restrict access to the plug once it is inserted into the adapter.

7. The electrical adapter plug according to claim 1, wherein the movable member is adapted to abut the plug casing.

* * * * *